US008139086B2

(12) United States Patent
Tu et al.

(10) Patent No.: US 8,139,086 B2
(45) Date of Patent: Mar. 20, 2012

(54) IMAGE PROCESSING METHOD AND SYSTEM

(75) Inventors: Chieh-Sheng Tu, Hsinchu (TW); Chung-Hsin Chen, Hsinchu (TW); Nai-Wen Cheng, Hsinchu (TW); Chun-Min Chen, Hsinchu (TW); Chi-Chuang Hsu, Hsinchu (TW)

(73) Assignee: Nuvoton Technology Corporation, Hsinchu (TW)

( * ) Notice: Subject to any disclaimer, the term of this patent is extended or adjusted under 35 U.S.C. 154(b) by 820 days.

(21) Appl. No.: 12/117,234

(22) Filed: May 8, 2008

(65) Prior Publication Data

US 2009/0079760 A1 Mar. 26, 2009

(30) Foreign Application Priority Data

Sep. 20, 2007 (TW) ..... 96135096 A

(51) Int. Cl.
*G09G 5/00* (2006.01)

(52) U.S. Cl. ..... 345/629; 345/419; 348/218.1

(58) Field of Classification Search ..... 345/419, 345/629; 348/40, 42, 218.1
See application file for complete search history.

(56) References Cited

U.S. PATENT DOCUMENTS

| | | | | |
|---|---|---|---|---|
| 5,686,960 | A * | 11/1997 | Sussman et al. | 348/218.1 |
| 2006/0232541 | A1 | 10/2006 | Kudo et al. | |
| 2007/0177004 | A1* | 8/2007 | Kolehmainen et al. | 348/42 |
| 2009/0128666 | A1* | 5/2009 | Rappaport et al. | 348/241 |
| 2009/0219380 | A1* | 9/2009 | Cable | 348/40 |
| 2009/0322738 | A1* | 12/2009 | Cable | 345/419 |

FOREIGN PATENT DOCUMENTS

| | | |
|---|---|---|
| TW | 357323 | 5/1999 |
| TW | 521257 | 2/2003 |
| TW | 200402682 A1 | 2/2004 |
| WO | WO-2007085874 A1 | 8/2007 |

* cited by examiner

*Primary Examiner* — Chante Harrison
(74) *Attorney, Agent, or Firm* — Muncy, Geissler, Olds & Lowe, PLLC

(57) ABSTRACT

The invention provides an image processing method. An image is provided, and the image is divided into a first subimage, a second subimage, a third subimage, and a fourth subimage according to a decomposing method. Next, the first, second, third, and fourth subimages are processed to generate a first subframe, a second subframe, a third subframe, and a fourth subframe. Finally, the first, second, third, and fourth subframes are combined as a frame according to a composing method corresponding to the decomposing method.

21 Claims, 8 Drawing Sheets

IMAGE PROCESSING METHOD AND SYSTEM

BACKGROUND OF THE INVENTION

1. Field of the Invention

The invention relates to image processing, and more particularly to an image processing method and system capable of dividing images into several partitions, processing the partitions, and recombining the processed partitions as one image.

2. Description of the Related Art

For conventional hardware design of video game consoles, image processing (e.g. rendering, special effect, rotation, scaling, etc.) or display hardware is designed based on Quart Video Graphics Array (QVGA). FIG. 1A shows a QVGA image 100 with 320×240 resolution. The QVGA image 100 includes 240 pixel rows, and each pixel row includes 320 pixels. The QVGA image 100 can be generated by combining several processed QVGA images. For example, a QVGA image with horizontal flip can be combined with another QVGA image by alpha blending to generate the QVGA image 100. FIG. 1B shows a conventional timing diagram and hardware design of a video game console. The monitor 102 consists of 262 scan lines, whereby the 1st~17th scan lines and the 258th~262th scan lines are called a vertical blanking period. A vertical blanking period comprises a vertical front porch, a vertical back porch, and a vertical sync used for signal calibration and separation of consecutive images. It is noted that no image data exist in the scan lines during the vertical blanking period.

The counter 110 corresponds to the displaying time of scan lines on the monitor 102. For example, the monitor 102 displays the 1st scan line when the counter 110 count to 1, the monitor 102 displays the 2nd scan line when the counter 110 counts to 2, and so on. Moreover, the 18th scan line on the monitor 102 corresponds to the 1st pixel row of the QVGA image 100, the 19th scan line on the monitor 102 corresponds to the 2nd pixel row of QVGA image 100, and so on. The row buffers 104, 106, 108 can respectively store one pixel row of image 100. The row buffer 104 can store the 18th, 21st, 24th scan lines on the monitor 102, the row buffer 106 can store the 19th, 22nd, 25th scan lines on the monitor 102, and the row buffer 108 can store the 20th, 23rd, 26th scan lines on the monitor 102. The processing circuits may include a sprite circuit and a background circuit. Because each processing circuit can only process one pixel row at a time, the image processing of the QVGA image 100 should be operated as a pipeline to achieve the best performance.

The image processing pipeline of the QVGA image 100 is described as follows. When the counter 110 counts from 1 to 15, the sprite circuit and background circuit do not work. When the counter 110 counts to 16, the sprite circuit starts processing the 1st pixel row of the QVGA image 100, and then stores the processed 1st pixel row in the row buffer 104. When the counter 110 counts to 17, the background circuit starts processing the 1st pixel row of the QVGA image 100, and then stores the processed 1st pixel row in the row buffer 104. Concurrently, the sprite circuit starts processing the 2nd pixel row of the QVGA image 100, and then stores the processed 2nd pixel row in the row buffer 106. When the counter 110 counts to 18, the display circuit 112 reads the 1st pixel row from the row buffer 104 and display the 1st pixel row on the 18th scan line. Concurrently, the background circuit starts processing the 2nd pixel row of the QVGA image 100, and then stores the processed 2nd pixel row in the row buffer 106 and the sprite circuit starts processing the 3rd pixel row of the QVGA image 100, and then stores the processed 3rd pixel row in the row buffer 108. Continuing the process, when the counter 110 counts to 257, the display circuit 112 reads the 240th pixel row of the QVGA image 100 from the row buffer 108 and displays the 240th pixel row on the 257th scan line, whereby the QVGA image 100 is completely processed and displayed on the monitor 102.

However, as display device resolution capabilities rise, video games with higher resolutions (e.g. VGA (640×480) video games) are being developed. Accordingly, using available processing circuits to achieve higher-resolution image processing is needed in the art.

BRIEF SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The invention provides an image processing method. Firstly, an image is acquired. Next, the image is divided into a first subimage, a second subimage, a third subimage, and a fourth subimage according to a decomposing method. Next, image processing is executed on the first, second, third, and fourth subimages to respectively generate a first subframe, a second subframe, a third subframe, and a fourth subframe. Finally, the processed first, second, third, and fourth subframes are combined as a frame according to a composing method corresponding to the decomposing method.

The invention also provides an image processing system. The image processing system comprises a storage device, a plurality of processing circuits, a plurality of row buffers, a plurality of subframe buffers, and a display circuit. The storage device stores a plurality of images. The images respectively compose a plurality of pixel rows. The processing circuits respectively read the images from the storage device and sequentially execute image processing on the pixel rows. The row buffers store the processed pixel rows. The subframe buffers read the processed pixel rows from the row buffers to compose a plurality of subframes. The display circuit reads the subframes from the subframe buffers, combines the subframes to generate a frame according to a composing method, and converts the frame to a display signal.

The invention also provides an image processing method. Firstly, an image is acquired. Next, the image is divided into a first subimage, a second subimage, a third subimage, and a fourth subimage according to a decomposing method. Next, a first image process is executed on the first, second, third, and fourth subimages to respectively generate a first subframe, a second subframe, a third subframe, and a fourth subframe. Next, the processed first, second, third, and fourth subframes are combined as a first frame according to a composing method corresponding to the decomposing method. Next, a second image process is executed on the first subimage to generate a fifth subframe. Finally, the processed fifth, second, third, and fourth subframes are combined as a second frame according to the composing method.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1A:
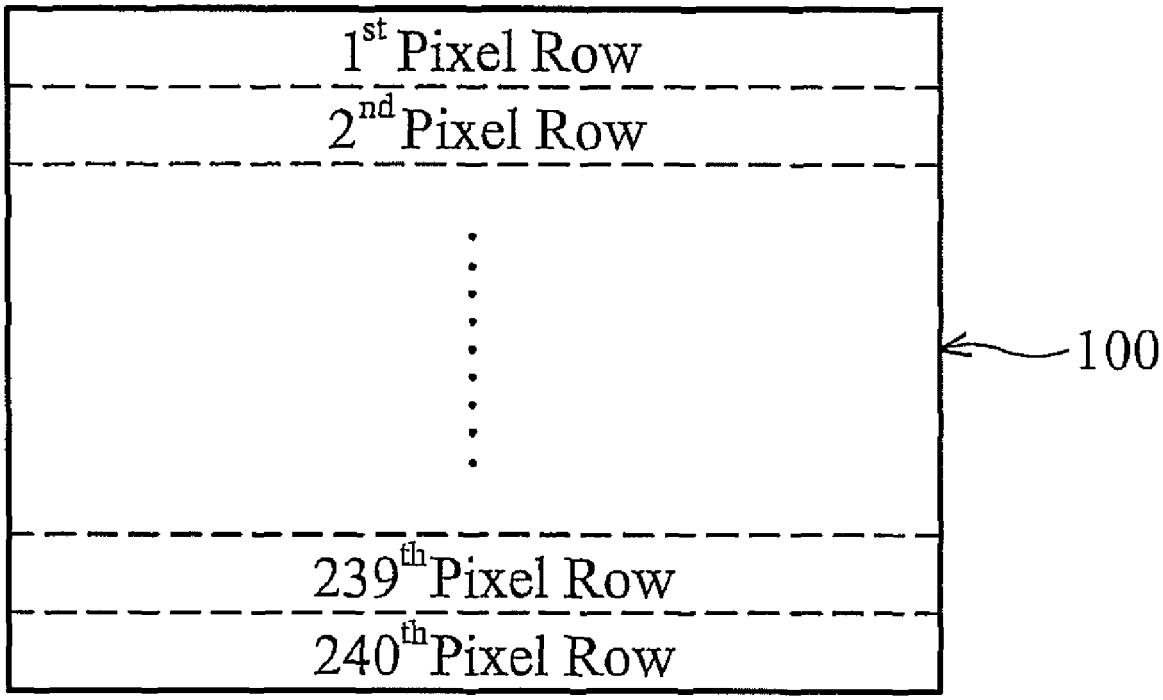
FIG. 1A is a QVGA image with 320×240 resolution.
Figure 1B:
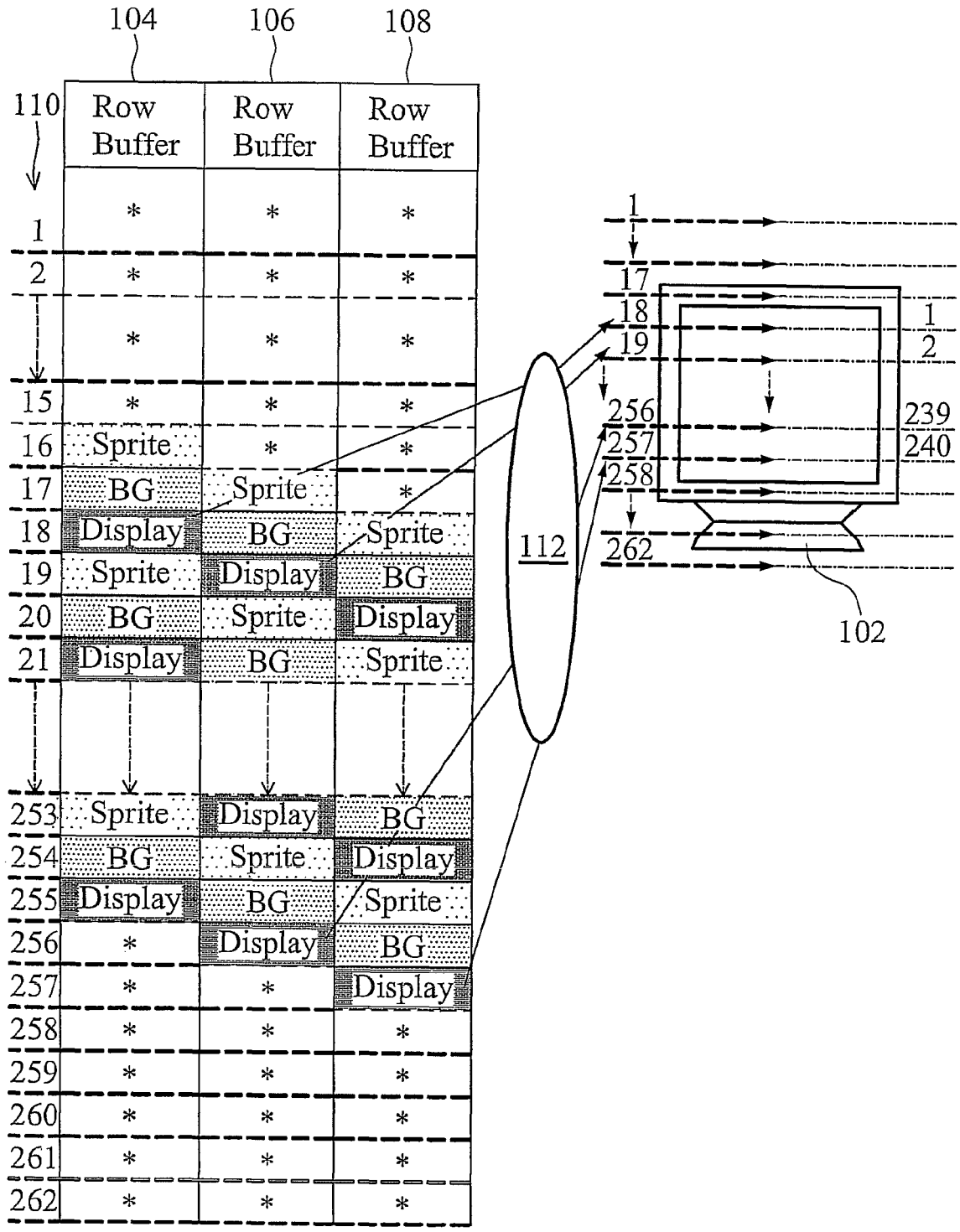
FIG. 1B is a timing diagram and hardware design of conventional image processing of video games.
Figure 2:
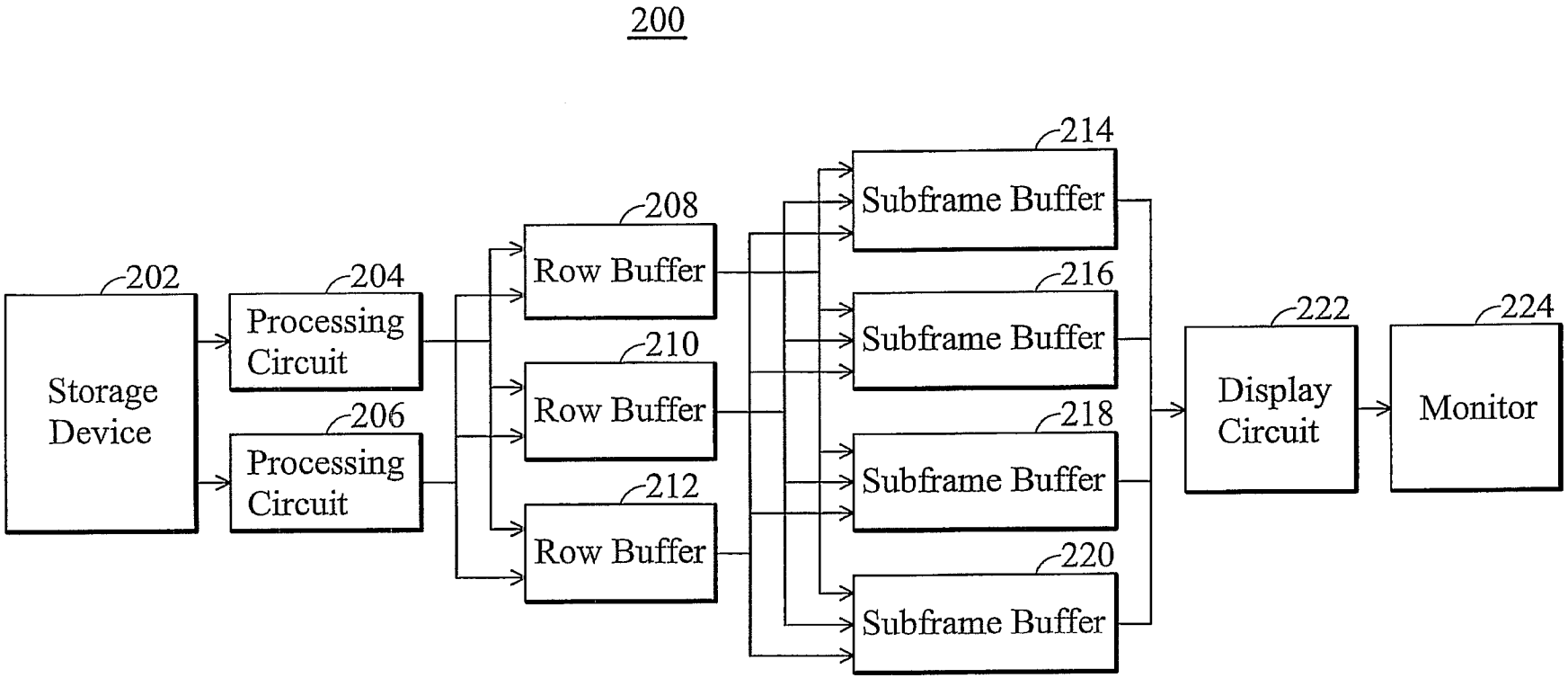
FIG. 2 is a system embodiment capable of processing VGA images by QVGA hardware according to the invention.

FIG. 2 is a system embodiment of the invention. The Image processing system 200 can utilize QVGA hardware to process VGA images. The storage device 202 can store a plurality of QVGA images. The storage device 202 can be volatile memory such as a static random access memory (SRAM), a dynamic random access memory (DRAM), and a synchronous dynamic random access memory (SDRAM). The storage device 202 can also be non-volatile memory such as a flash memory, a hard disk, an optical disk, and an Erasable Programmable Read Only Memory (EPROM).

The processing circuits 204 and 206 can respectively read the QVGA images from the storage device 202 for executing different image processing. The processing circuits 204 and 206, for example, can be a sprite circuit and a background circuit. A sprite circuit can execute a sprite operation to integrate a two-dimensional or three-dimensional image or animation (e.g. a monster or a player in a video game) into a background scene. A background circuit can execute a background operation, such as executing scaling, rotation, flipping, or alpha-blending on one or more images to compose a background scene. One skilled in the art would know that the image processing system 200 can comprise other processing circuits to achieve more complicated image processing, reduce processing circuits to simplify the image processing, or add some identical processing circuits to increase specific processing efficiency. Additionally, the processing circuits 204 and 206 can respectively process one pixel row (320×1 pixels) at a time in the embodiment.

The row buffers 208, 210, and 212 can respectively store one pixel row processed by the processing circuits 204 or 206. The row buffers 208, 210, and 212 can be volatile memory (e.g. SRAM, DRAM, or SDRAM). When a pixel row has been processed by the processing circuit 204 and 206, the pixel row will be forwarded from a row buffer to a corresponding subframe buffer. The subframe buffer 214, 216, 218, and 220 can respectively store a QVGA image (i.e. 320×240 pixels). The subframe buffer 214, 216, 218, and 220 can be volatile memory (e.g. SRAM, DRAM, or SDRAM). When the pixel rows stored in each subframe buffer 214, 216, 218, and 220 constitute a VGA frame, the display circuit 222 will read the four subframes from the subframe buffer 214, 216, 218, and 220 and combine the four subframes to generate a VGA frame according to a composing method. Finally, the display circuit 224 converts the VGA frame to a the display signal according to the display requirements of the monitor 224, and then the monitor 224 will display the VGA frame according to the display signal.

Figure 3A:
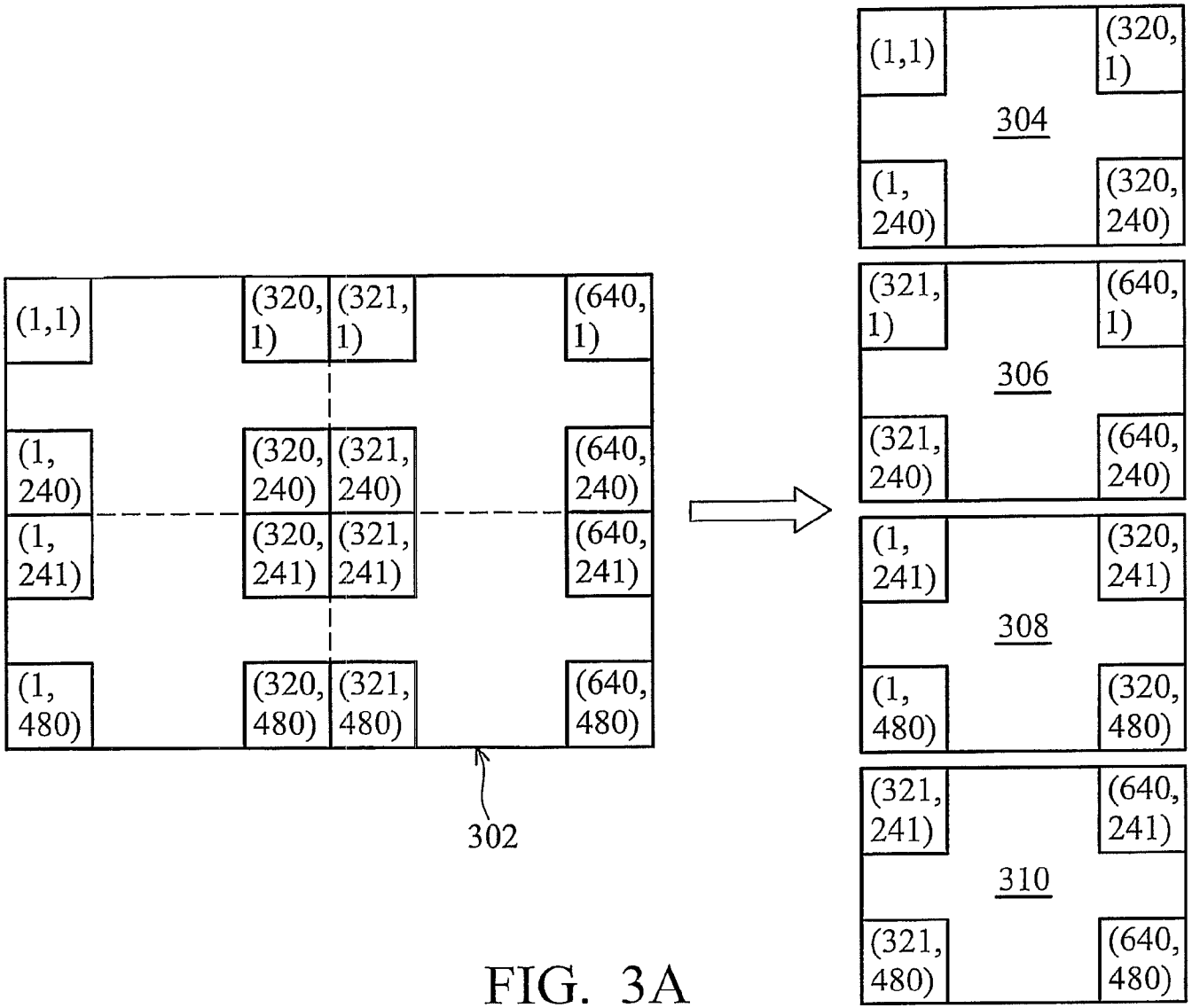
FIG. 3A-3C shows three different decomposing methods of a VGA image.

In FIG. 2, the QVGA images stored in storage device 202 can be decomposed from a plurality of VGA images according to a decomposing method. The decomposing method is shown in FIG. 3A for one embodiment. Referring to FIG. 3A, the image 302 is a VGA image having 640×480 pixels. For example, (1, 1) represents a pixel at the 1st column and the 1st row of image 302, and (320, 1) represents a pixel at the 320th column and the 1st row of image 302. The image 302 can be divided into subimages 304, 306, 308, and 310, and each subimage 304, 306, 308, and 310 are QVGA images (i.e. 320×240 pixels). The subimage 304 is the upper-left quarter of image 302, the subimage 306 is the upper-right quarter of image 302, the subimage 308 is the lower-left quarter of image 302, and the subimage 310 is the lower-right quarter of image 302. The subimages 304, 306, 308, and 310 can be stored in the storage device 202 for use by the image processing system 200. It is noted that the composing method corresponds to the decomposing method to combine four QVGA subframes as a VGA frame.

Figure 3B:
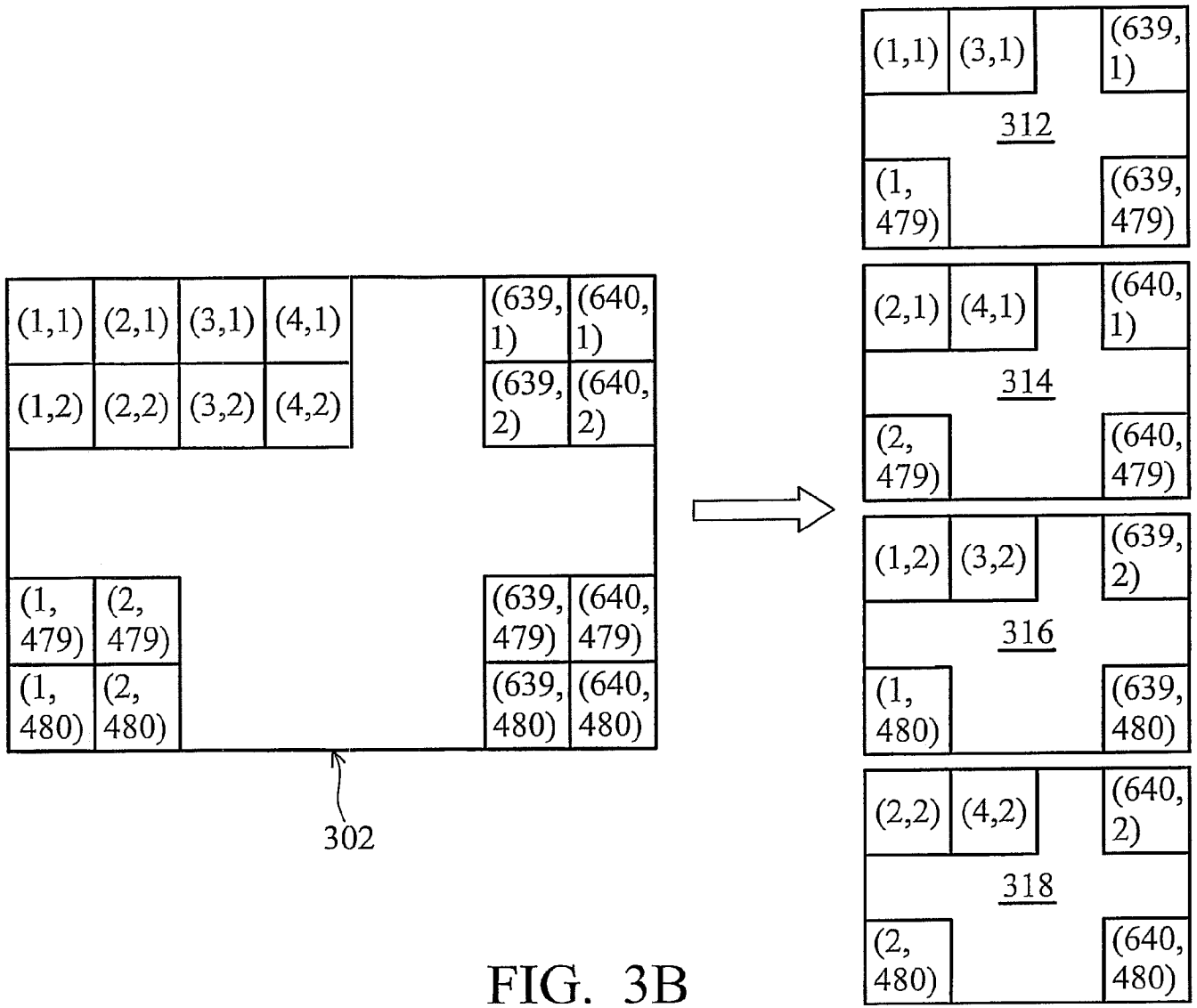

Another embodiment of the decomposing method is shown in FIG. 3B. The image 302 can be divided into subimages 312, 314, 316, and 318, and each subimage 312, 314, 316, and 318 are QVGA images. The subimage 312 comprises all odd pixels of all odd rows of image 302. For example, the four pixels (1, 1), (3, 1), (1, 479), and (639, 479) are allocated to subimage 312. The subimage 314 comprises all even pixels of all odd rows of image 302, the subimage 316 comprises all odd pixels of all even rows of image 302, and the subimage 318 comprises all even pixels of all even rows of image 302. The subimages 312, 314, 316, and 318 can be stored in storage device 202 for use by the image processing system 200. It is noted that the composing method corresponds to the decomposing method to combine four QVGA subframes as a VGA frame.

Figure 3C:
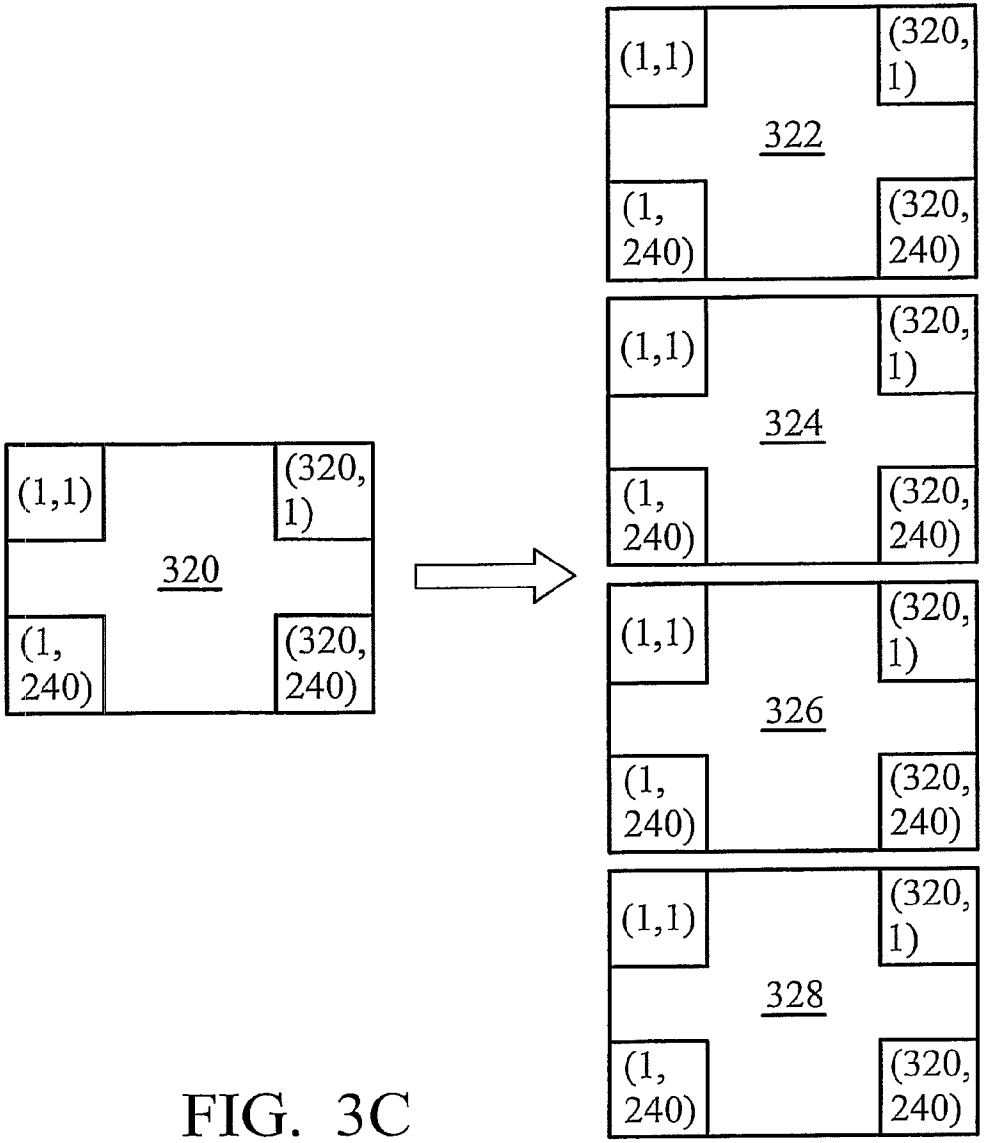

In a specific embodiment, the QVGA images stored in the storage device 202 are duplicates of other QVGA images. As shown in FIG. 3C, the image 320 is a QVGA image having 320×240 pixels, and the image 320 can be duplicated as subimages 322, 324, 326, and 328. The subimages 322, 324, 326, and 328 can be stored in the storage device 202 for use by the image processing system 200. It is noted that the composing method corresponds to the decomposing method described in FIG. 3B to combine four QVGA subframes as a VGA frame.

Figure 4:
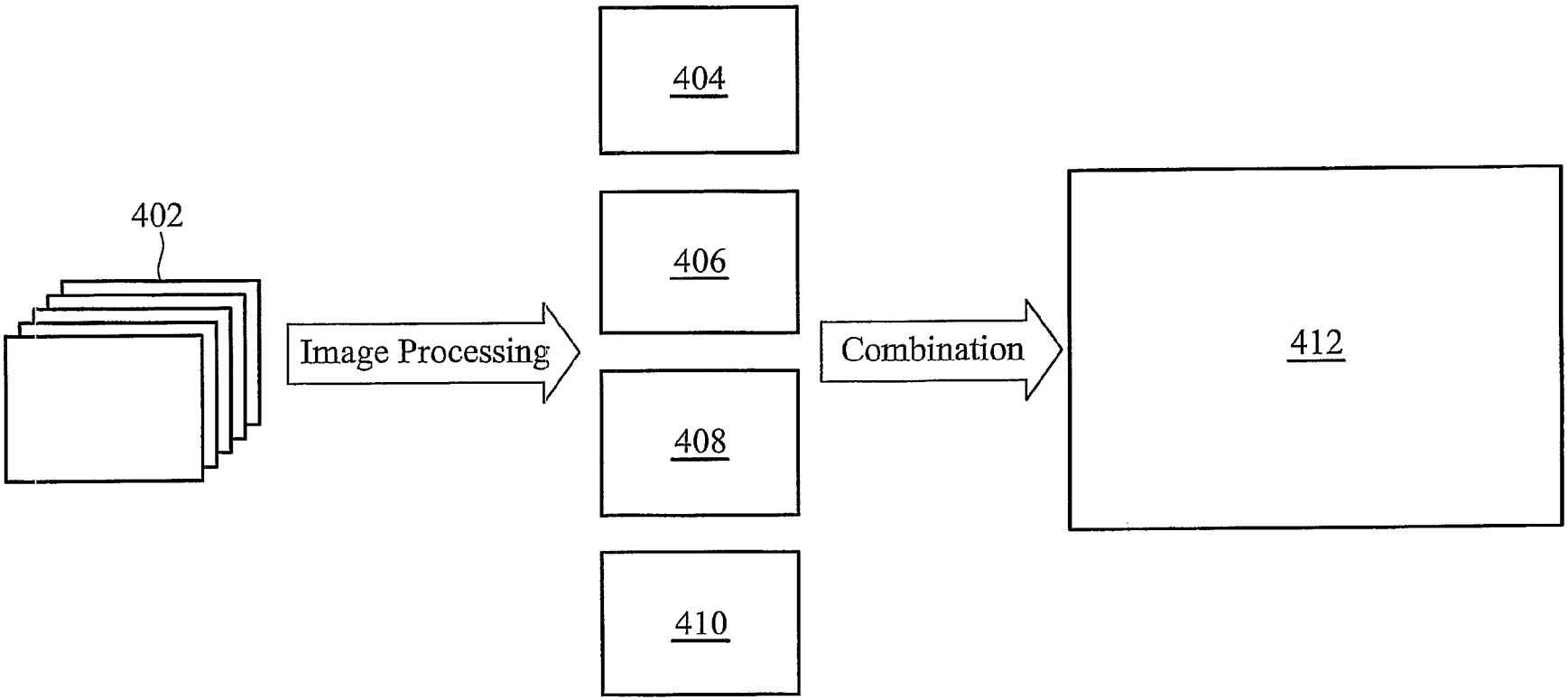
FIG. 4 shows how to combine four QVGA images as one VGA image.

FIG. 4 shows how the image processing system 200 combines QVGA subframes as a VGA frame. The subimage group 402 is QVGA images decomposed from VGA images according to one decomposing method of FIG. 3A-3C and is stored in the storage device 202. The image processing system 200 can process the subimage group 402 by processing circuits 204 and 206 according to the display requirements of video games and the decomposing method to generate the QVGA subframe 404, and store the subframe 404 in the subframe buffer 214. Similarly, the QVGA subframe 406, 408, and 410 can be generated by processing the subimage group 402 by the processing circuit 204 and 206 according to the display requirements of video games and the decomposing method, and respectively be stored in the subframe buffers 216, 218, and 220. Finally, the display circuit 222 can combine the QVGA subframes 404, 406, 408, and 410 as a VGA frame 412 according to a composing method corresponding to the decomposing method. Accordingly, the image processing system 200 can use the QVGA hardware to achieve VGA image processing.

Figure 5:
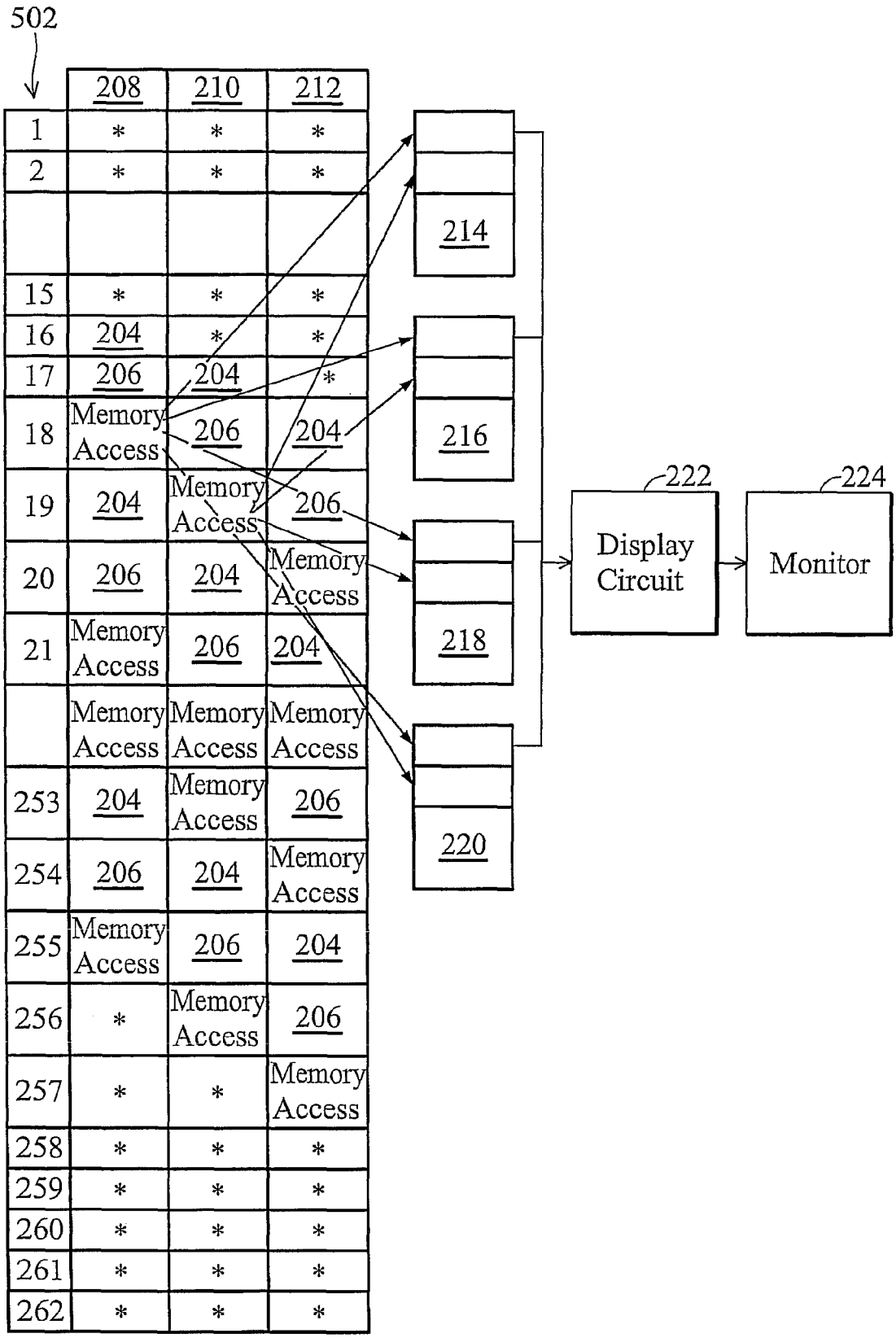
FIG. 5 is a timing diagram of an embodiment according to the invention.

FIG. 5 shows an embodiment of time diagram and hardware design of the image processing system 200. The image processing system 200 generates subframes 404, 406, 408, and 410 by pipeline. Take the generation of the subframe 404 for example, when the counter 502 counts from 1 to 15, the processing circuits 204 and 206 remain idle. When the counter 502 counts to 16, the processing circuit 204 starts processing the 1st pixel row of the subframe 404 and then stores the processed 1st pixel row in the row buffer 208. When the counter 502 counts to 17, the processing circuit 206 starts processing the 1st pixel row of the subframe 404 and then stores the processed 1st pixel row in the row buffer 208. Concurrently, the processing circuit 204 starts processing the 2nd pixel row of the subframe 404 and then stores the processed 2nd pixel row in the row buffer 210. When the counter 502 counts to 18, the processed 1st pixel row is read from the row buffer 208 and stored in the subframe buffer 214. Concurrently, the processing circuit 206 starts processing the 2nd pixel row of the subframe 404 and then stores the processed 2nd pixel row in the row buffer 210. Continuing the process, when the counter 502 counts to 257, the 240th pixel row is read from the row buffer 212 and stored in the subframe buffer 214, whereby all pixel rows of the subframe 404 are completely processed and stored in the subframe buffer 214.

Similarly, subframes 406, 408, and 410 can be sequentially processed in the same way when the counter 502 is reset to 1, and respectively stored in the subframe buffers 216, 218, and 220. Finally, the display circuit 222 can read the subframes 404, 406, 408, and 410 from the subframe buffers 214, 216, 218, and 220, combine the subframes 404, 406, 408, and 410 as a VGA frame 412 according to a composing method corresponding to a decomposing method used by the system, convert a VGA frame 412 to a display signal, such as a progressed signal or a interlaced signal, and transfer the display signal to a monitor 224 for displaying the VGA frame 412.

It is noted that the number of row buffers and processing circuits are determined according to how many types of image processing are needed because the image processing system 200 is operated as pipeline. For example, if one video game only needs a sprite operation and a background operation, at least two processing circuits and three row buffers are required in the image processing system 200. The number of row buffers is required to be at least one more than the number of processing circuits because the subframe buffers need one counting period to access the row buffers. Additionally, the number of subframe buffers is determined by the number of partitions of a VGA image. For example, if a VGA image is divided into four QVGA images, four subframe buffers are required in the image processing system 200. Moreover, the image processing system 200 can achieve dual display, and the display circuit 222 can generate various display signals according to the display requirements.

In one embodiment, the image processing system 200 can achieve improved performance. The refresh rate of a video game is required to be at least larger than 30 images per seconds (ips) to satisfy the persistence of vision for the human eye. The background scene of a video game, may remain the same for a longer period of time while only objects move along the background scene. Accordingly, only the changed partition can be refreshed and while other areas remain unchanged to save memory bandwidth. For example, if a player only moves within the upper-left quarter of a VGA screen and the background scene remains the same, the image processing system 200 can refresh the upper-left QVGA subframe, while the previous upper-right, lower-left, and lower-right QVGA subframes remain unchanged, and combine the four QVGA subframes as a new VGA frame according to a composing method corresponding to the decomposing method described in FIG. 3A.

In another embodiment, a VGA image can be divided into two 320×480 images (i.e. a left-half part and a right-half part). Only two subframe buffers capable of storing a 320×480 image are required in the image processing system 200. In other embodiments, the invention is not limited to processing VGA images by QVGA hardware, i.e. the invention can process higher resolution images by using hardware capable of processing lower resolution images.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An image processing method, comprising:

acquiring an image;

dividing the image into a first subimage, a second subimage, a third subimage, and a fourth subimage according to a decomposing method;

executing an image process onto the first, second, third, and fourth subimages to respectively generate a first subframe, a second subframe, a third subframe, and a fourth subframe; and combining the first, second, third, and fourth subframes as a frame according to a composing method corresponding to the decomposing method, wherein only one of the first, second, third, and fourth subimages is executed at one time, and wherein the first, second, third, and fourth subimages are respectively composed of a plurality of pixel rows, and one of the following operations is respectively executed on the pixel rows at the same time:

executing one of the image processes;

storing to the first, second, third, or fourth subframe when the image process is executed; and staying idle, wherein the storing operation is executed on only one of the pixel rows.

2. The image processing method as claimed in claim 1, wherein the decomposing method comprises respectively setting the first subimage as an upper-left quarter of the image, setting the second subimage as an upper-right quarter of the image, setting the third subimage as a lower-left quarter of the image, and setting the first subimage as a lower-right quarter of the image.

3. The image processing method as claimed in claim 1, wherein the decomposing method comprises setting the first subimage as all odd pixels of all odd rows of the image, setting the second subimage as all even pixels of all odd rows of the image, setting the third subimage as all odd pixels of all even rows of the image, and setting the fourth subimage as all even pixels of all even rows of the image.

4. The image processing method as claimed in claim 1, wherein the image and the frame are VGA images, and the first, second, third, and fourth subimages and the first, second, third, and fourth subframes are QVGA images.

5. The image processing method as claimed in claim 1, wherein the decomposing method comprises duplicating the image as the first, second, third, and fourth subimages.

6. The image processing method as claimed in claim 5, wherein the composing method comprises setting the first subframe as all odd pixels of all odd rows of the frame, setting the second subframe as all even pixels of all odd rows of the frame, setting the third subframe as all odd pixels of all even rows of the frame, and setting the fourth subframe as all even pixels of all even rows of the frame.

7. The image processing method as claimed in claim 6, wherein the image and the frame are VGA images, and the first, second, third, and fourth subimages and subframes are QVGA images.

8. The image processing method as claimed in claim 1, wherein the image process comprises a sprite operation, a rotation operation, a scaling operation, a flipping operation, an alpha-blending operation, or a combination of operations.

9. The image processing method as claimed in claim 1, wherein the image process executed on each of the pixel rows are different at one time.

10. An image processing method, comprising:

acquiring an image;

dividing the image into a first subimage, a second subimage, a third subimage, and a fourth subimage according to a decomposing method;

executing an image process onto the first, second, third, and fourth subimages to respectively generate a first subframe, a second subframe, a third subframe, and a fourth subframe;

combining the first, second, third, and fourth subframes as a frame according to a composing method corresponding to the decomposing method;

executing a second image process onto the first subimage to generate a fifth subframe; and combining the second, third, fourth, and fifth subframes as a second image according to the composing method, wherein only one of the first, second, third, and fourth subimages is executed at one time, and wherein the first, second, third, and fourth subimages are respectively composed of a plurality of pixel rows, and one of the following operations is respectively executed on the pixel rows at the same time:

executing one of the image processes;

storing to the first, second, third, or fourth subframe when the image process is executed; and staying idle, wherein the storing operation is executed on only one of the pixel rows.

11. The image processing method as claimed in claim 10, further comprising:

executing the second image process onto the second subimage to generate a sixth subframe; and combining the third, fourth, fifth, and sixth subframes as a third image according to the composing method.

12. The image processing method as claimed in claim 11, further comprising:

executing the second image process onto the third subimage to generate a seventh subframe; and combining the fourth, fifth, sixth, and seventh subframes as a fourth image according to the composing method.

13. An image processing system, comprising:

a storage device configured to store a plurality of images, wherein the images respectively composing of a plurality of pixel rows;

a plurality of processing circuits respectively configured to read the image from the storage device and execute an image process, wherein each of the processing circuits processes one of the pixel rows at a time;

a plurality of row buffers configured to store the processed pixel rows;

a plurality of subframe buffers configured to read the processed pixel rows from the row buffers to compose a plurality of subframes; and a display circuit configured to read the subframes from the subframe buffers, combine the subframes to generate a frame according to a composing method, and convert the frame to a display signal.

14. The image processing system as claimed in claim 13, wherein one of the processing circuits is a sprite circuit.

15. The image processing system as claimed in claim 13, wherein one of the processing circuits is a background circuit configured to execute a rotation operation, a scaling operation, a flipping operation, an alpha blending operation, or a combination of operations.

16. The image processing system as claimed in claim 13, wherein the number of row buffers is larger than the number of processors, and the number of subframe buffers is equal to the number of subframes.

17. The image processing system as claimed in claim 13, wherein the composing method comprises, setting a first subframe of the subframes as an upper-left quarter of the frame, setting a second subframe of the subframes as an upper-right quarter of the frame, setting a third subframe of the subframes as a lower-left quarter of the frame, and setting a fourth subframe of the subframes as a lower-right quarter of the frame.

18. The image processing system as claimed in claim 13, wherein the composing method comprises, setting a first subframe of the subframes as all odd pixels of all odd rows of the frame, setting a second subframe of the subframes as all even pixels of all odd rows of the frame, setting a third subframe of the subframes as all odd pixels of all even rows of the frame, and setting a fourth subframe of the subframes as all odd pixels of all even rows of the frame.

19. The image processing system as claimed in claim 18, wherein the first, second, third, and fourth subframes are identical.

20. The image processing system as claimed in claim 13, wherein the subframes and the images are QVGA images, and the frame is a VGA image.

21. The image processing system as claimed in claim 13, wherein the combination method comprises setting a first subframe of the subframes as a left half of the frame, and setting a second subframe of the subframes as a right half of the frame.

* * * * *